US011083948B1

(12) United States Patent
Swartwood

(10) Patent No.: US 11,083,948 B1
(45) Date of Patent: Aug. 10, 2021

(54) TENNIS-STROKE TRAINER DEVICE

(71) Applicant: Paul Swartwood, Blackduck, MN (US)

(72) Inventor: Paul Swartwood, Blackduck, MN (US)

( * ) Notice: Subject to any disclaimer, the term of this patent is extended or adjusted under 35 U.S.C. 154(b) by 0 days.

(21) Appl. No.: 17/171,872

(22) Filed: Feb. 9, 2021

Related U.S. Application Data

(60) Provisional application No. 62/972,049, filed on Feb. 9, 2020.

(51) Int. Cl.
*A63B 69/38* (2006.01)
*A63B 69/00* (2006.01)

(52) U.S. Cl.
CPC ..... *A63B 69/0091* (2013.01); *A63B 69/38* (2013.01)

(58) Field of Classification Search
CPC ..... A63B 69/0091; A63B 69/38
USPC ..... 473/417, 418, 422, 423, 426, 429, 430, 473/451, 459
See application file for complete search history.

(56) References Cited

U.S. PATENT DOCUMENTS 2,305,187 A * 12/1942 Neiden ..... A63B 69/0091 473/429
2,976,040 A * 3/1961 Bales ..... A63B 69/0079 473/429
3,876,203 A 4/1975 Gold
4,042,237 A 8/1977 Moraru
4,089,521 A 5/1978 Berst et al.
4,477,083 A 10/1984 Sowards
5,553,848 A * 9/1996 Amron ..... A63B 69/0002 473/416
5,618,039 A * 4/1997 Tsai ..... A63B 69/0091 473/423
6,976,926 B2 * 12/2005 LaPointe ..... A63B 69/0084 473/422
7,115,052 B2 * 10/2006 Wardle ..... A63B 69/38 473/459
2001/0036874 A1 11/2001 Cathcart

FOREIGN PATENT DOCUMENTS

WO WO2017141270 A1 8/2017

* cited by examiner

*Primary Examiner* — Nini F Legesse

(57) ABSTRACT

A tennis-stroke trainer device is an apparatus that allows a user to perform various tennis strokes repetitively. The apparatus includes a frame, a training ball, a pair of length-adjustable fasteners, and an elastic cord. The frame offset and rotates the training ball around a post. The post is preferably a tennis post. The frame includes a U-shaped bracket, a cantilever arm, a counterfort arm, and a hook. The U-shaped bracket offsets and mounts both the cantilever arm and the counterfort arm with the post. The hook stretches the elastic cord along the cantilever arm. The training ball is preferably a large foam ball and serves as a target for the user. The pair of length-adjustable fasteners mounts the U-shaped bracket with the desired post. The elastic cord retracts the cantilever arm and the counterfort arm, and consequently the training ball after the training ball has been hit by the user.

14 Claims, 8 Drawing Sheets

TENNIS-STROKE TRAINER DEVICE

The current application claims a priority to the U.S. provisional patent application Ser. No. 62/972,049 filed on Feb. 9, 2020.

FIELD OF THE INVENTION

The present invention generally relates to sports equipment. More specifically, the present invention is a tennis-stroke trainer.

BACKGROUND OF THE INVENTION

Tennis is played in countries all around the world. There are over 17 million tennis players in the United States. There are over 14,000 certified tennis teaching professionals in the United States. Teaching professionals are always looking for new and improved ways to teach students. Teaching aids are a commonly used to help players better understand the mechanics of the various tennis strokes. An essential skill for playing tennis is to better understand and learn top spin and back spin.

The present invention is a portable training aid that simulates the movement of a tennis ball. The present invention provides tennis players with a controlled and repetitive opportunity to practice the tennis racket motion required to generate top spin and backspin. Each time the player hits a foam ball of the present invention, the foam ball spins and swings away from them, then returns to a neutral position to be hit again. This provides the player with an opportunity to practice their strokes in a more focused and controlled setting.

DETAIL DESCRIPTIONS OF THE INVENTION

All illustrations of the drawings are for the purpose of describing selected versions of the present invention and are not intended to limit the scope of the present invention.

Figure 1:
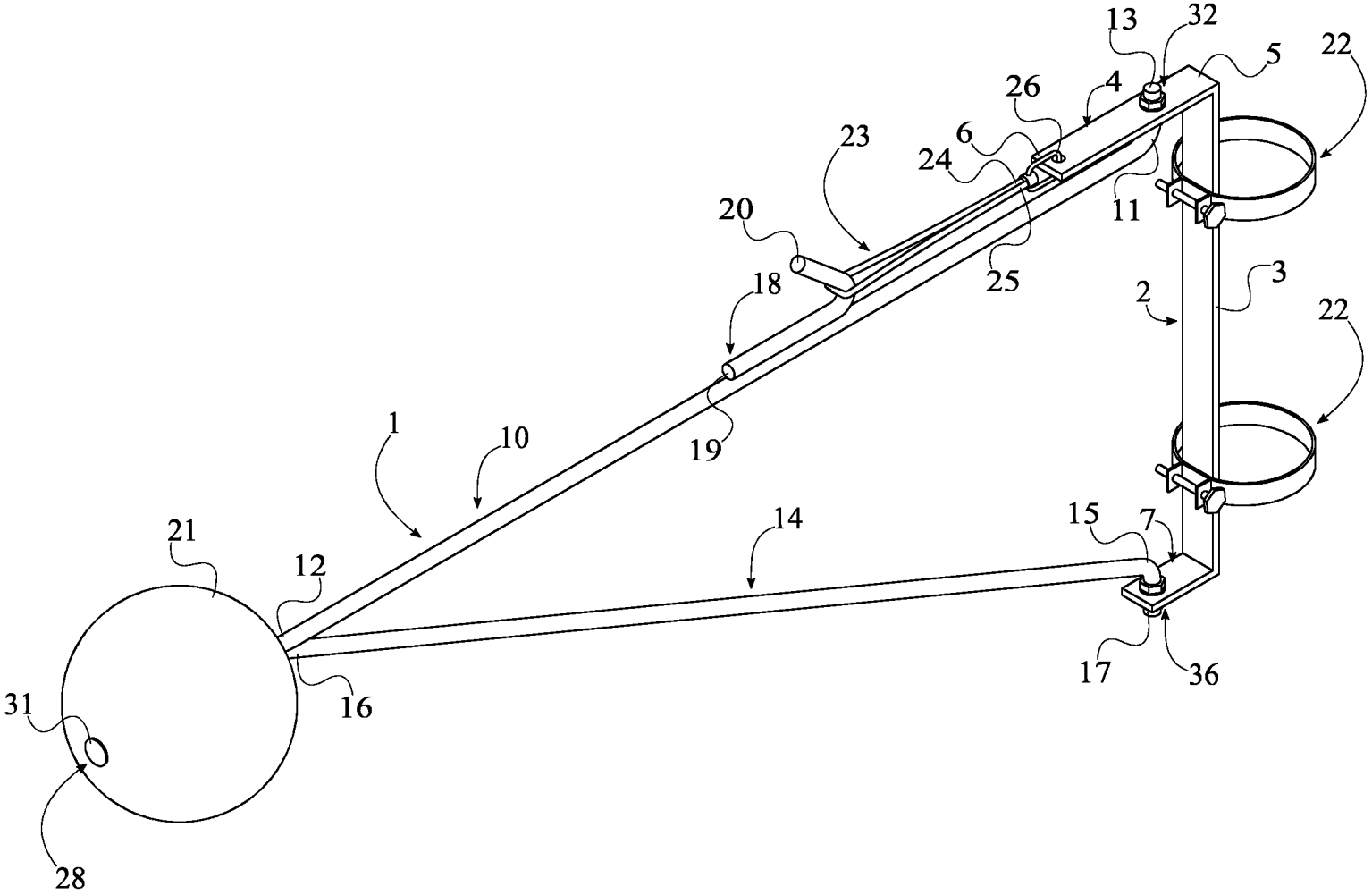
FIG. 1 is a perspective view of the present invention.
Figure 2:
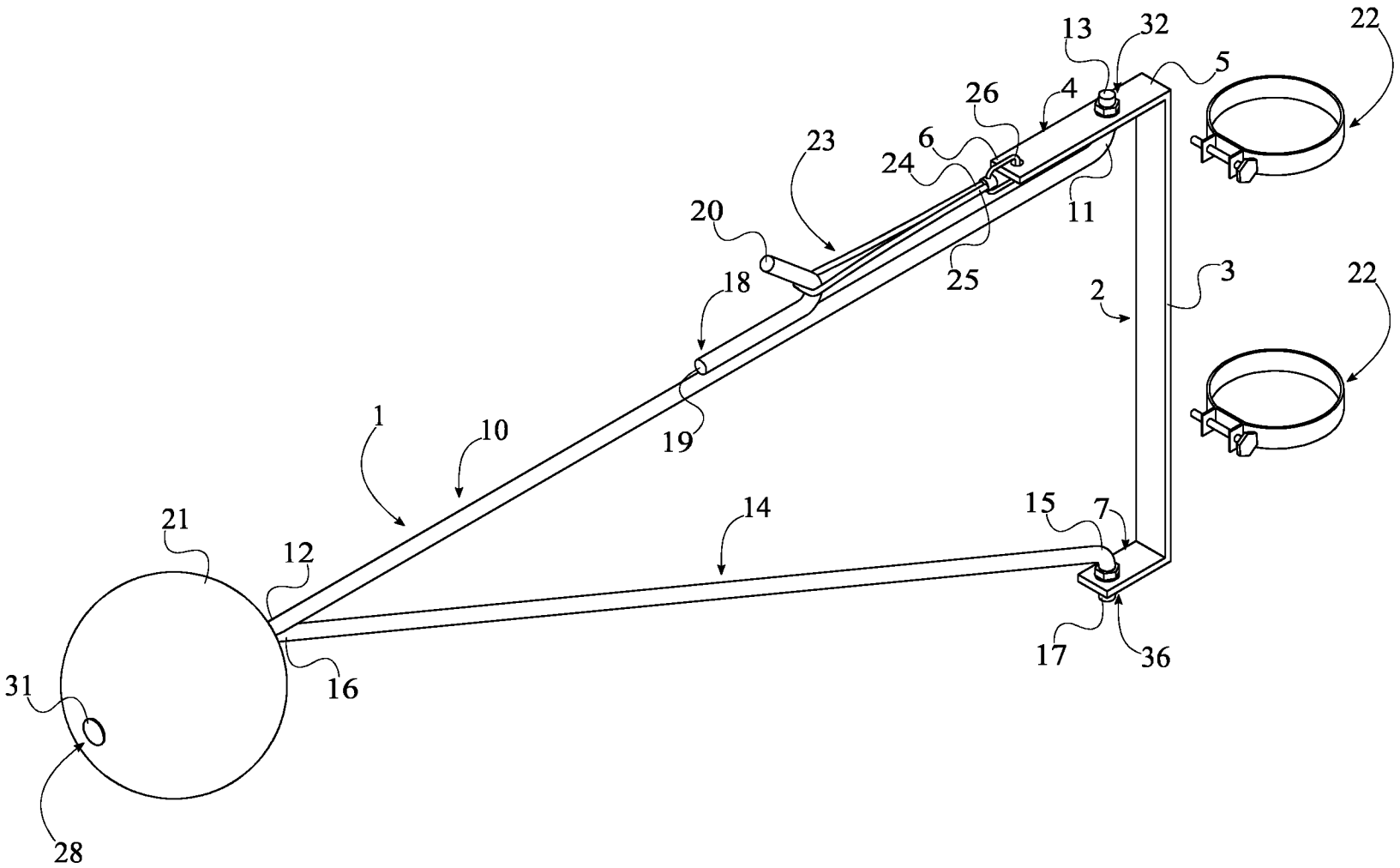
FIG. 2 is an exploded view of the present invention.

The present invention is a tennis-stroke trainer device. The present invention serves as a training tool for tennis players. The present invention serves to improve the form of a user. The present invention allows a user to practice various tennis strokes, such as a top spin and a back spin, repetitively. The present invention also only requires a post such as a tennis post or a pole so that the user may use the present invention individually, requiring no additional assistance. A preferred embodiment of the present invention comprises a frame 1, a training ball 21, a pair of length-adjustable fasteners 22, and an elastic cord 23, seen in FIG. 1 and FIG. 2. The frame 1 upholds and positions the training ball 21 with a tennis post or the like. The frame 1 comprises a U-shaped bracket 2, a cantilever arm 10, a counterfort arm 14, and a hook 18. The U-shaped bracket 2 serves as a mount for the cantilever arm 10 and the counterfort arm 14 with the tennis post. The U-shaped bracket 2 comprises a connecting rod 3, an upper leg 4, and a lower leg 7. The connecting rod 3 presses against the post and stabilizes the U-shaped bracket 2 across the tennis post. The upper leg 4 secures the cantilever arm 10 with the U-shaped bracket 2, and the lower leg 7 secures the counterfort arm 14 with the U-shaped bracket 2. The cantilever arm 10 and the counterfort arm 14 provide the structural integrity for the frame 1 so that the user may hit the training ball 21 with the force as if the training ball 21 was an actual tennis ball. The training ball 21 serves as a target for the user. The training ball 21 is preferably a foam ball so that a tennis racket is not damaged after multiple hits with the training ball 21. The pair of length-adjustable fasteners 22 secures the frame 1 with the tennis post and a variety of posts. The pair of length-adjustable fasteners 22 is preferably a pair of steel band clamps. In alternate embodiments of the present invention, the pair of length-adjustable fasteners 22 may be, but is not limited to, various clamps, ropes, and straps. The pair of length-adjustable fasteners 22 allows the present invention to be mounted to posts of varying shapes and sizes. The elastic cord 23 retracts both the cantilever arm 10 and the counterfort arm 14 after the training ball 21 has been hit by the user to a neutral position. While in the neutral position, the cantilever arm 10 is aligned with the upper leg 4, and the counterfort arm 14 is aligned with the lower leg 7.

The overall configuration of the aforementioned components allows the user to repetitively perform a top spin and a back spin with the present invention without having to reset the present invention after each hit. In order for the frame 1 to remain structurally sound as the training ball 21 is hit by the user, the upper leg 4 is terminally fixed with the connecting rod 3, seen in FIG. 1, FIG. 2, FIG. 3, and FIG. 5. Conversely, the lower leg 7 is terminally fixed with the connecting rod 3, opposite the upper leg 4. The pair of length-adjustable fasteners 22 is distributed in between the upper leg 4 and the lower leg 7 and is mounted onto the connecting rod 3, thereby securing and stabilizing the frame 1 with a tennis post. So that the cantilever arm 10 and the counterfort arm 14, and consequently the training ball 21, pivot about the frame 1, the upper leg 4 and the lower leg 7 are oriented away from the pair of length-adjustable fasteners 22. More specifically, a fixed end 11 of the cantilever arm 10 is rotatably mounted with the upper leg 4, and a fixed end 15 of the counterfort arm 14 is rotatably mounted with the lower leg 7. The training ball 21 remains connected with the frame 1 while the user performs various tennis strokes as the training ball 21 is rotatably mounted with a free end 12 of the cantilever arm 10. This engagement allows the training ball 21 to rotate in the direction that corresponds with the type of tennis stroke. The force of the tennis stroke against the training ball 21 is evenly distributed through the frame 1 as the free end 12 of the counterfort arm 14 is laterally fixed to the cantilever arm 10, offset from the free end 12 of the cantilever arm 10. More specifically, the cantilever arm 10 is positioned perpendicular with the connecting rod 3, and the counterfort arm 14 is oriented at an acute angle 43 with the connecting rod 3. This arrangement allows the cantilever arm 10 and the counterfort arm 14 to smoothly pivot about the connecting rod 3. The elastic cord 23 is mounted with the frame 1 as the hook 18 is laterally fixed to the cantilever arm 10, offset from the fixed end 11 of the cantilever arm 10. In order for the training ball 21 to return to the neutral position, the elastic cord 23 is tethered between the upper leg 4 and the hook 18.

In order to provide a secure connection between the cantilever arm 10 and the connecting rod 3 throughout rotation, the cantilever arm 10 may further comprise an upward bend 13, seen in FIG. 1, FIG. 2, FIG. 3, FIG. 5, and FIG. 6. The upward bend 13 extends the cantilever arm 10 into the upper leg 4 while maintaining the perpendicular arrangement with the connecting rod 3. The upward bend 13 is preferably shaped to be a 90-degree arc. More specifically, the upper leg 4 may comprise an upper leg end 5 and a lower leg end 6. As the fixed end 11 rotates with the upper leg 4, the upward bend 13 is integrated into the fixed end 11 of the cantilever arm 10. In order cantilever arm 10 to be connected with the upper leg 4, the upper leg end 5 is positioned opposite the lower leg end 6 along the upper leg 4. Moreover, the upper leg end 5 is fixed adjacent with the connecting rod 3, and the lower leg end 6 is tethered with the elastic cord 23. This arrangement allows the elastic cord 23 to freely extend and retract. The cantilever arm 10 freely pivots as the upward bend 13 is positioned in between the upper leg end 5 and the lower leg end 6. Furthermore, the upper bend is rotatably connected with the upper leg 4.

Similarly, the counterfort arm 14 may further comprise a downward bend 17. The downward bend 17 extends the counterfort arm 14 into the lower leg 7 while preserving the acute angle between the cantilever arm 10 and the counterfort arm 14, seen in FIG. 1, FIG. 2, FIG. 3, FIG. 5, and FIG. 7. More specifically, the downward bend 17 is shaped to be an obtuse arc. As the fixed end 15 rotates with the lower leg 7, the downward bend 17 is integrated into the fixed end 15 of the counterfort arm 14. The counterfort arm 14 freely pivots as the downward bend 17 is rotatably connected with the lower leg 7.

The structural integrity of the elastic cord 23 is preserved as the present invention may further comprise an eyelet 26, seen in FIG. 1, FIG. 2, FIG. 3, FIG. 4, FIG. 5, and FIG. 6. The eyelet 26 connects the elastic cord 23 with the upper leg 4 so that the elastic cord 23 does not get abraded or torn with the upper leg 4 as the cantilever arm 10 pivots. A loop is defined with the elastic cord 23 as the elastic cord 23 may comprise a first cord end 24 and a second cord end 25. In order for the elastic cord 23 to latch onto the hook 18, the hook 18 may comprise a shank 19 and a horizontal bend 20. The shank 19 connects the horizontal bend 20 with the cantilever arm 10. The elastic cord 23 is secured along the cantilever arm 10 with the hook 18 as the shank 19 is fixed along the cantilever arm 10, and the horizontal bend 20 is oriented towards the training ball 21. The loop is defined as the first cord end 24 and the second cord end 25 are laterally fixed to the eyelet 26. The elastic cord 23 is looped around the hook 18. This arrangement further preserves the elastic cord 23 and allows the elastic cord 23, along with the eyelet 26 to be easily interchanged or replaced. Moreover, the upper leg 4 is positioned into the eyelet 26, thereby pulling the cantilever arm 10 back into the neutral position with the upper leg 4.

Figure 5:
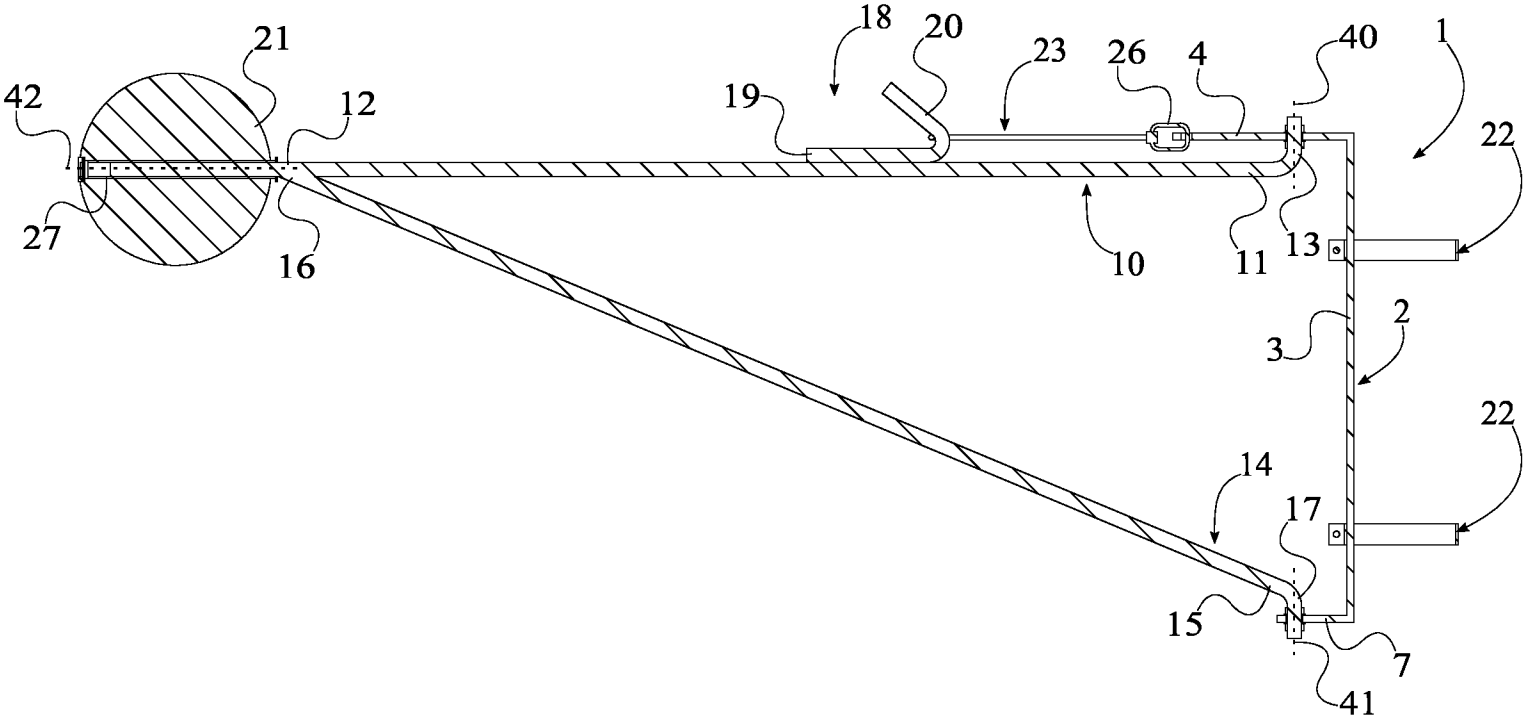
FIG. 5 is a cross-section view taken along line 5-5 in FIG. 4.
Figure 8:
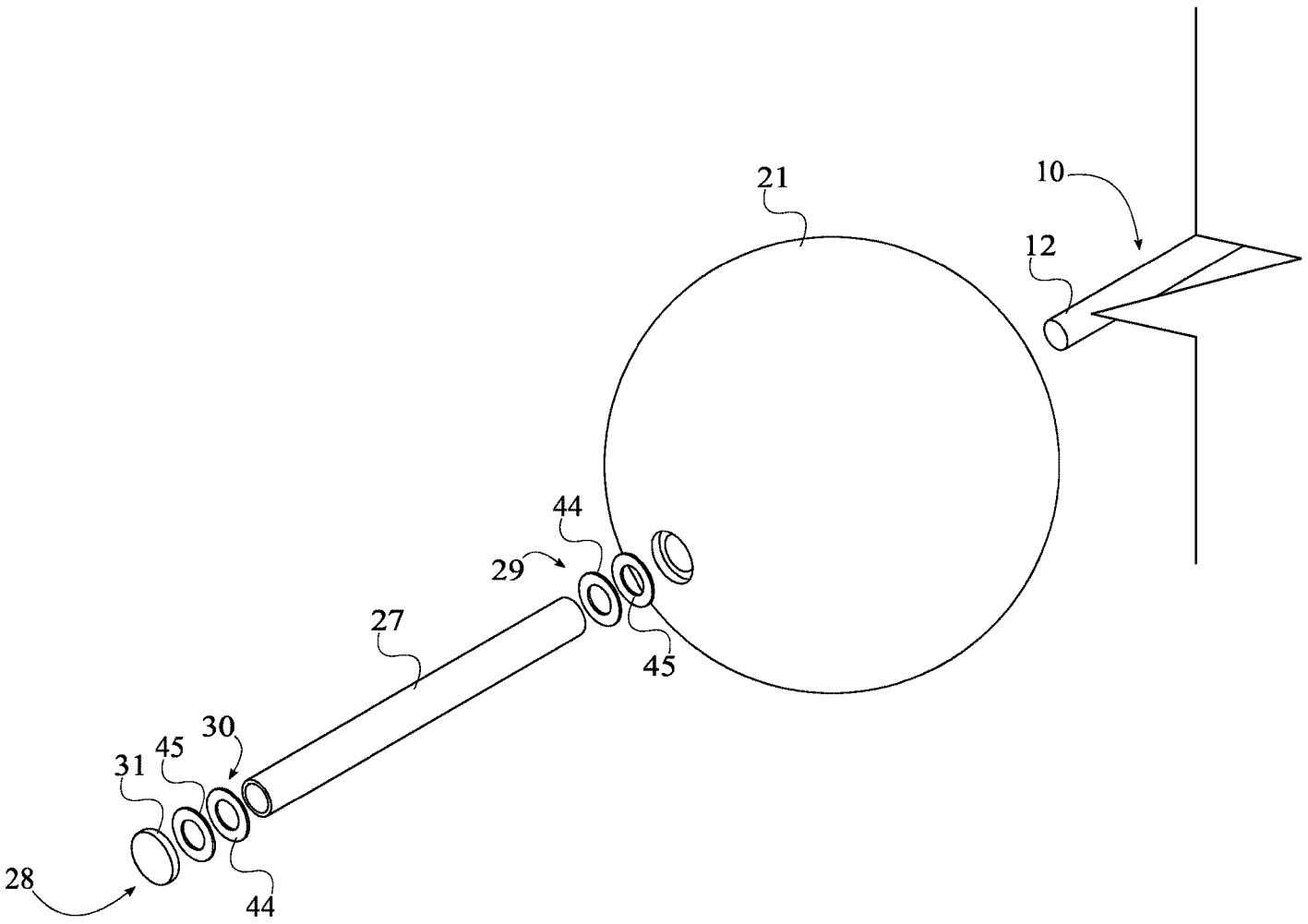
FIG. 8 is an enlarged view of a ball-fastening assembly of the present invention.

In order for the training ball 21 to freely rotate with the cantilever arm 10 while remaining secure with the cantilever arm 10, the present invention may further comprise a tubing 27 and a ball-fastening assembly 28, seen in FIG. 5 and FIG. 8. The tubing 27 reduces the friction between the training ball 21 and the cantilever arm 10. The tubing 27 is preferably made of nylon. The ball-fastening assembly 28 secures the training ball 21 with the cantilever arm 10. The ball-fastening assembly 28 may comprise a pair of proximal washers 29, a pair of distal washers 30, and a stop fastener 31. The pair of proximal washers 29 reduces the friction between the training ball 21 with both the free end 12 of the cantilever arm 10 and the free end 16 of the counterfort arm 14. The pair of distal washers 30 reduces the friction between the stop fastener 31 and the training ball 21. In the preferred embodiment of the present invention, the pair of proximal washers 29 and the pair of distal washers 30 may each comprise a nylon washer 44 and metal washer 45. Moreover, the nylon washer 44 is positioned in between the metal washer 45 and the tubing 27. The training ball 21 freely rotates about the cantilever arm 10 as the tubing 27 is diametrically integrated through the training ball 21. The cantilever arm 10 is positioned through the pair of proximal washers 29, the tubing 27, and the pair of distal washers 30, so that the training ball 21 remains on cantilever arm 10 while rotating. Furthermore, the pair of proximal washers 29, the tubing 27, and the pair of distal washers 30 are rotatably engaged with the cantilever arm 10. The rotation of the training ball 21 is uninhibited with both the free end 12 of the cantilever arm 10 and the free end 16 of the counterfort arm 14 and with the stop fastener 31 as the tubing 27 is positioned in between the pair of proximal washers 29 and the pair of distal washers 30. More specifically, the pair of proximal washers 29 is positioned adjacent with the free end 12 of the cantilever arm 10, and the pair of distal washers 30 is positioned with the free end 12 of the cantilever arm 10. The training ball 21 does not slip past the cantilever arm 10 as the stop fastener 31 is positioned adjacent with the pair of distal washers 30, opposite the tubing 27. The stop fastener 31 is threadedly engaged to the distal end so that the training ball 21 is interchangeable or replaceable.

Figure 6:
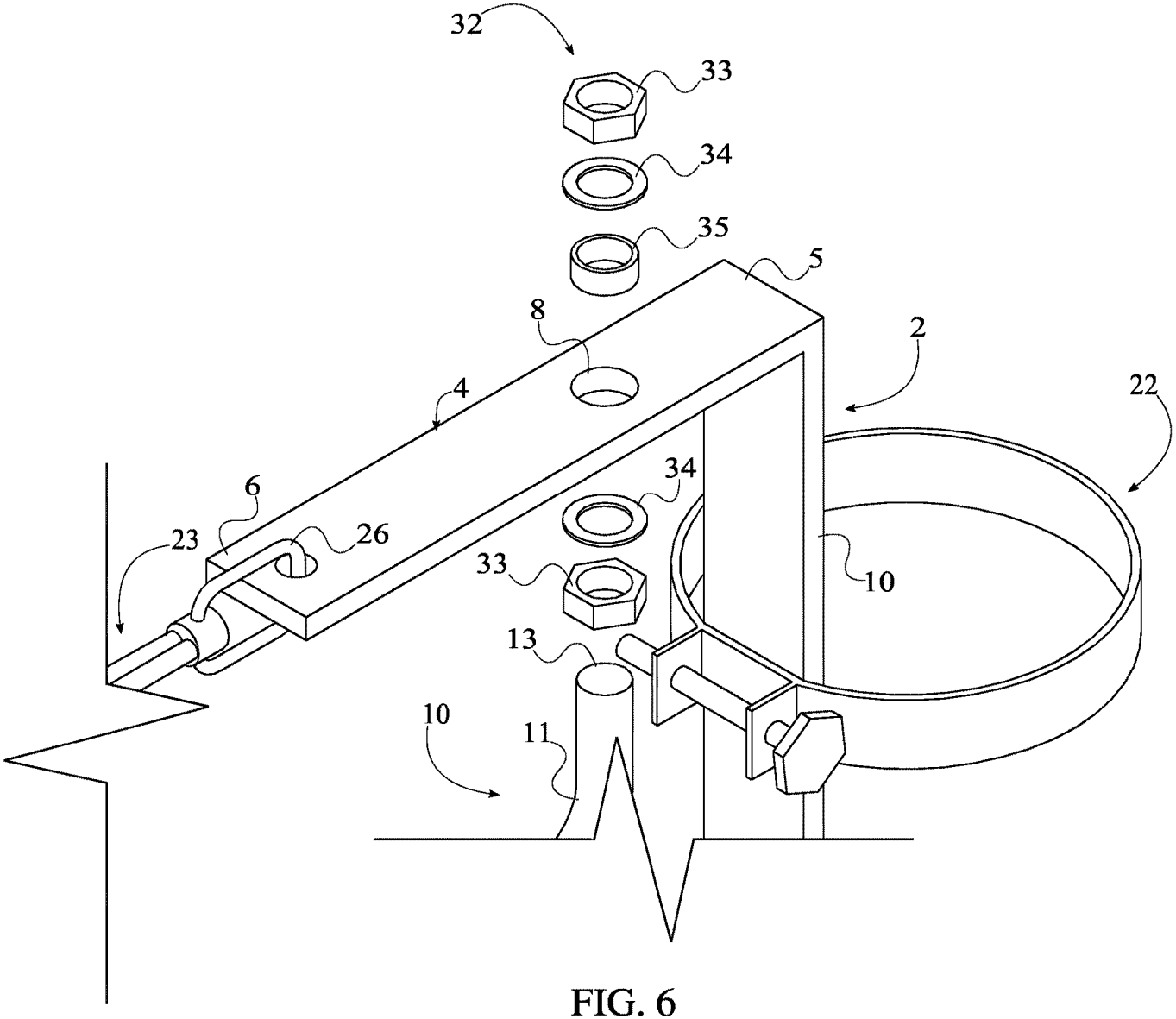
FIG. 6 is an enlarged view of a first fastening assembly of the present invention.
Figure 7:
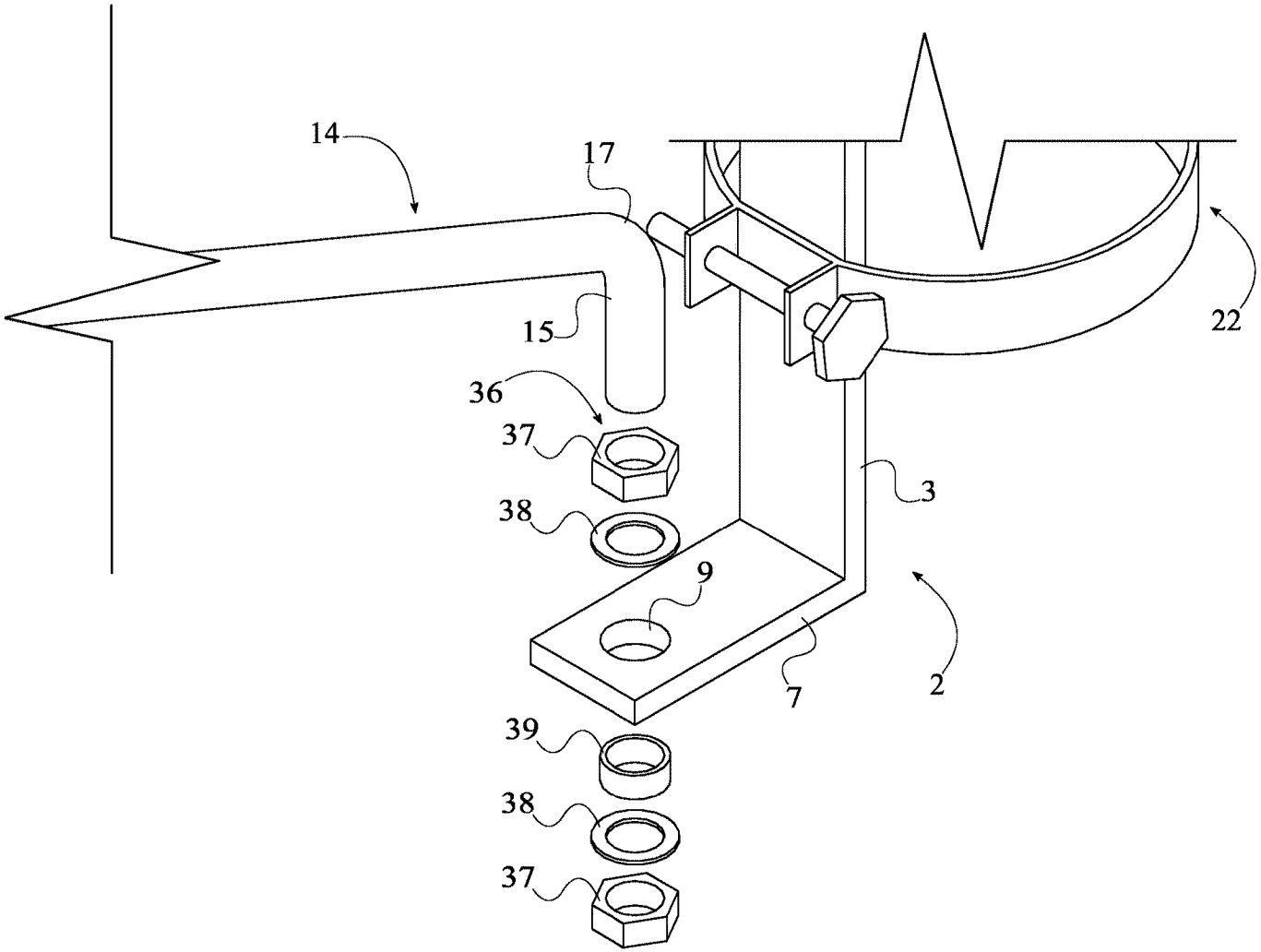
FIG. 7 is an enlarged view of a second fastening assembly of the present invention.

Similarly, the cantilever arm 10 and the counterfort arm 14 freely rotate with the frame 1 while remaining connected with the frame 1 as the present invention may further comprise a first fastening assembly 32 and a second fastening assembly 36, seen in FIG. 6 and FIG. 7, respectively. The first fastening assembly 32 secures the connection between the cantilever arm 10 and the upper leg 4. The second fastening assembly 36 secures the connection between the counterfort arm 14 and the lower leg 7. The first fastening assembly 32 may comprise a pair of first fasteners 33, a pair of first washers 34, and a first bushing 35. Furthermore, the U-shaped bracket 2 may further comprise a first hole 8. The pair of first fasteners 33 locks the cantilever arm 10 through the upper leg 4. The pair of first washers 34 allows the cantilever arm 10 to freely rotate while locked into the first hole 8 with the pair of first fasteners 33. The first bushing 35 reduces the friction between cantilever arm 10 and the upper leg 4. In order for the cantilever arm 10 to be connected with the upper leg 4, the first hole 8 laterally traverses through the upper leg 4. The pair of first washers 34 is positioned in between the pair of first fasteners 33 so that the rotation of the cantilever arm 10 remains uninhibited. Furthermore, the first bushing 35 is positioned in between the pair of first washers 34, further facilitating the rotation of the cantilever arm 10. In order to reduce the friction between the cantilever arm 10, specifically the upward bend 13, with that of the upper leg 4, the first bushing 35 is mounted through the first hole 8. More specifically, the fixed end 11 of the cantilever arm 10 traverses through the pair of first fasteners 33, the pair of first washers 34, and the first bushing 35. The pair of first fasteners 33 is threadedly engaged to the fixed end 11 of the cantilever arm 10 so that the cantilever arm 10, and consequently the counterfort arm 14, may be interchanged or replaced with the U-shaped bracket 2.

Likewise, the second fastening assembly 36 may comprise a pair of second fasteners 37, a pair of second washers 38, and a second bushing 39, seen in FIG. 7. The second fastening assembly 36 may comprise a pair of second fasteners 37, a pair of second washers 38, and a second bushing 39. Furthermore, the U-shaped bracket 2 may further comprise a second hole 9. The pair of second fasteners 37 locks the counterfort arm 14 through the lower leg 7. The pair of second washers 38 allows the counterfort arm 14 to freely rotate while locked into the second hole 9 with the pair of second fasteners 37. The second bushing 39 reduces the friction between counterfort arm 14 and the lower leg 7. In order for the counterfort arm 14 to be connected with the lower leg 7, the second hole 9 laterally traverses through the lower leg 7. The pair of second washers 38 is positioned in between the pair of second fasteners 37 so that the rotation of the counterfort arm 14 remains uninhibited. Moreover, the second bushing 39 is positioned in between the pair of second washers 38, further facilitating the rotation of the cantilever arm 10. In order to reduce the friction between the counterfort arm 14, specifically the downward bend 17, with that of the lower leg 7, the second bushing 39 is mounted through the second hole 9. More specifically, the fixed end 15 of the counterfort arm 14 traverses through the pair of second fasteners 37, the pair of second washers 38, and the second bushing 39. The pair of second fasteners 37 is threadedly engaged to the fixed end 15 of the counterfort arm 14 so that the cantilever arm 10, and consequently the counterfort arm 14, may be interchanged or replaced with the U-shaped bracket 2.

Figure 3:
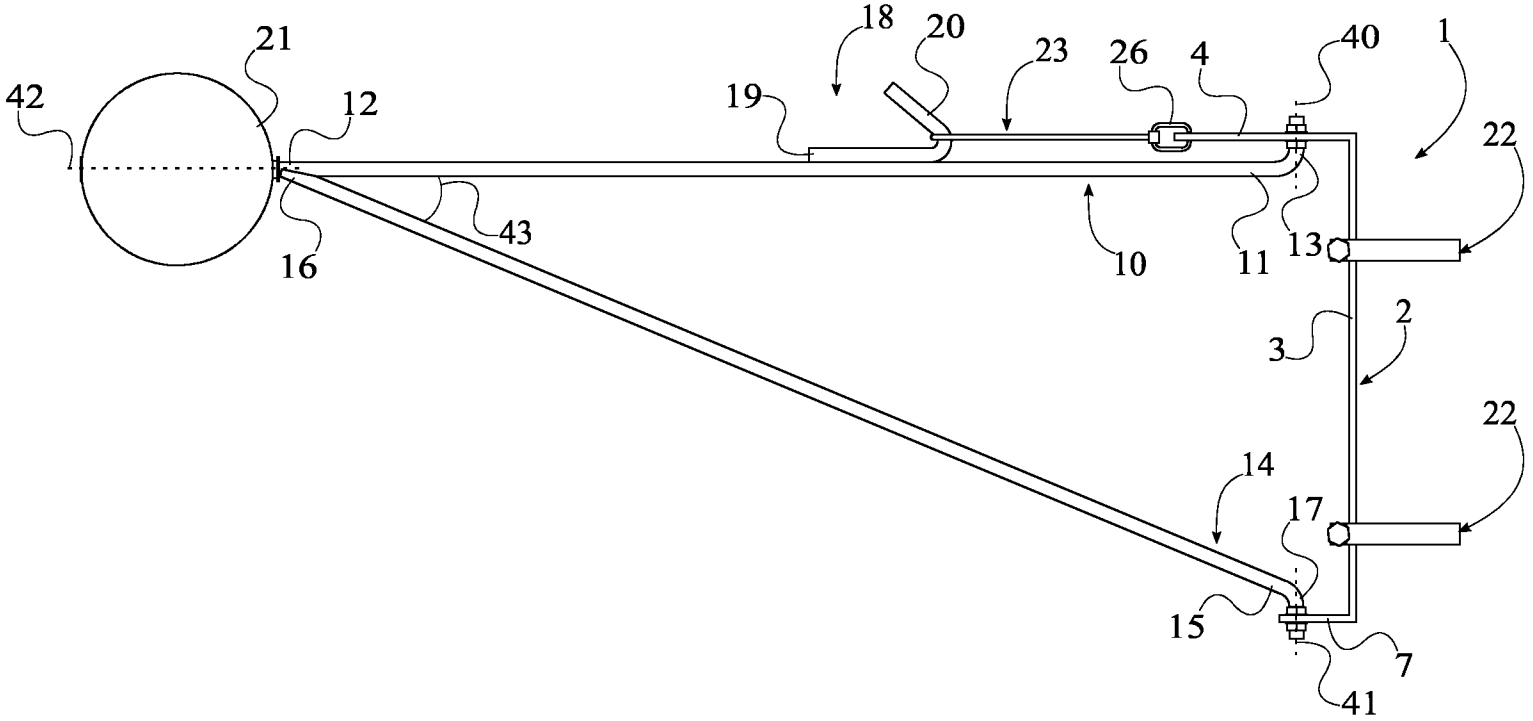
FIG. 3 is a side view of the present invention.
Figure 4:
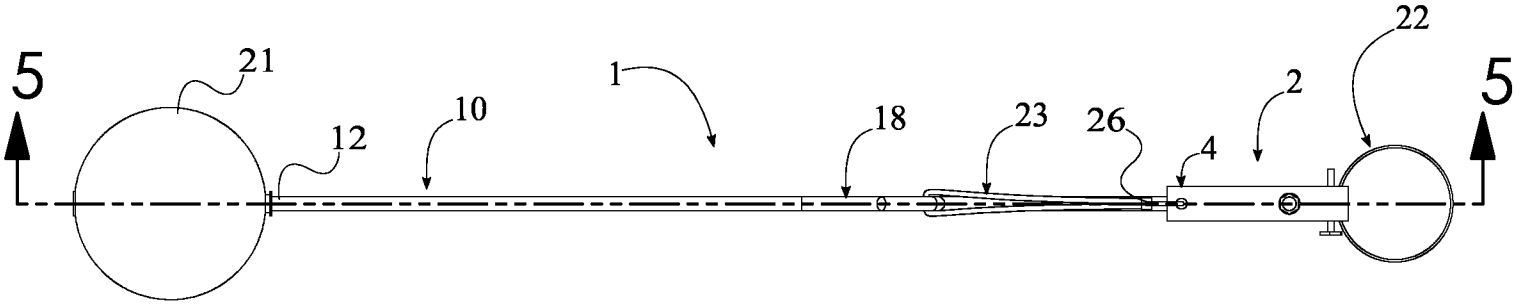
FIG. 4 is a top side view of the present invention.

In order for the cantilever arm 10 to freely pivot with the U-shaped bracket 2 and about a tennis post, a first rotation axis 40 is rotatably mounted between the fixed end 11 of the cantilever arm 10 and the upper leg 4, seen in FIG. 3. Likewise, in order for the counterfort arm 14 to freely pivot with the U-shaped bracket 2 and about the tennis post, a second rotation axis 41 is rotatably mounted between the fixed end 15 of the counterfort arm 14 and the lower leg 7. In order for the training ball 21 to rotate when struck by a tennis racket, a third rotation axis 42 is rotatably mounted between the training ball 21 and the free end 12 of the cantilever arm 10. Both the cantilever arm 10 and the counterfort arm 14 continuously pivot about the U-shaped bracket 2 as the first rotation axis 40 and the second rotation axis 41 are positioned colinear with each other. The present invention readily receives a hit from a tennis racket as the first rotation axis 40 and the second rotation axis 41 are positioned perpendicular with the third rotation axis 42.

Although the invention has been explained in relation to its preferred embodiment, it is to be understood that many other possible modifications and variations can be made without departing from the spirit and scope of the invention as hereinafter claimed.

What is claimed is:

1. A tennis-stroke trainer device comprises:

a frame;

a training ball;

a pair of length-adjustable fasteners;

an elastic cord;

the frame comprises a U-shaped bracket, a cantilever arm, a counterfort arm, and a hook;

the U-shaped bracket comprises a connecting rod, an upper leg, and a lower leg;

the upper leg being terminally fixed with the connecting rod;

the lower leg being terminally fixed with the connecting rod, opposite the upper leg;

the pair of length-adjustable fasteners being distributed in between the upper leg and the lower leg;

the pair of length-adjustable fasteners being mounted onto the connecting rod;

the upper leg and the lower leg being oriented away from the pair of length-adjustable fasteners;

a fixed end of the cantilever arm being rotatably mounted with the upper leg;

a fixed end of the counterfort arm being rotatably mounted with the lower leg;

the training ball being rotatably mounted with a free end of the cantilever arm;

the free end of the counterfort arm being laterally fixed to the cantilever arm, offset from the free end of the cantilever arm;

the hook being laterally fixed to the cantilever arm, offset from the fixed end of the cantilever arm; and, the elastic cord being tethered between the upper leg and the hook.

2. The tennis-stroke trainer device as claimed in claim 1, wherein the pair of length-adjustable fasteners is a pair of steel band clamps.

3. The tennis-stroke trainer device as claimed in claim 1 comprises:

the cantilever arm being positioned perpendicular with the connecting rod; and, the counterfort arm being oriented at an acute angle with the connecting rod.

4. The tennis-stroke trainer device as claimed in claim 1 comprises:

the cantilever arm further comprises an upward bend;

the upper leg comprises an upper leg end and a lower leg end;

the upward bend being integrated into the fixed end of the cantilever arm;

the upper leg end being positioned opposite the lower leg end along the upper leg;

the upper leg end being fixed adjacent with the connecting rod;

the lower leg end being tethered with the elastic cord;

the upward bend being positioned in between the upper leg end and the lower leg end; and, the upward bend being rotatably connected with the upper leg.

5. The tennis-stroke trainer device as claimed in claim 4, wherein the upward bend is shaped to be a 90-degree arc.

6. The tennis-stroke trainer device as claimed in claim 1 comprises:

the counterfort arm further comprises a downward bend;

the downward bend being integrated into the fixed end of the counterfort arm; and, the downward bend being rotatably connected with the lower leg.

7. The tennis-stroke trainer device as claimed in claim 6, wherein the downward bend is shaped to be an obtuse arc.

8. The tennis-stroke trainer device as claimed in claim 1 comprises:

an eyelet;

the elastic cord comprises a first cord end and a second cord end;

the hook comprises a shank and a horizontal bend;

the shank being fixed along the cantilever arm;

the horizontal bend being oriented towards the training ball;

the first cord end and the second cord end being laterally fixed to the eyelet;

the elastic cord being looped around the hook; and, the upper leg being positioned into the eyelet.

9. The tennis-stroke trainer device as claimed in claim 1 comprises:

a tubing;

a ball-fastening assembly;

the ball-fastening assembly comprises a pair of proximal washers, a pair of distal washers, and a stop fastener;

the tubing being diametrically integrated through the training ball;

the cantilever arm being positioned through the pair of proximal washers, the tubing, and the pair of distal washers;

the pair of proximal washers, the tubing, and the pair of distal washers being rotatably engaged with the cantilever arm;

the tubing being positioned in between the pair of proximal washers and the pair of distal washers;

the pair of proximal washers being positioned adjacent with the free end of the cantilever arm;

the pair of distal washers being positioned with the free end of the cantilever arm;

the stop fastener being positioned adjacent with the pair of distal washers, opposite the tubing; and, the stop fastener being threadedly engaged to the distal end.

10. The tennis-stroke trainer device as claimed in claim 9 comprises:

the pair of proximal washers and the pair of distal washers each comprise a nylon washer and a metal washer; and, the nylon washer being positioned in between the metal washer and the tubing.

11. The tennis-stroke trainer device as claimed in claim 9, wherein the tubing is made of nylon.

12. The tennis-stroke trainer device as claimed in claim 1 comprises:

a first fastening assembly;

the first fastening assembly comprises a pair of first fasteners, a pair of first washers, and a first bushing;

the U-shaped bracket further comprises a first hole;

the first hole laterally traversing through the upper leg;

the pair of first washers being positioned in between the pair of first fasteners;

the first bushing being positioned in between the pair of first washers;

the first bushing being mounted through the first hole;

the fixed end of the cantilever arm traversing through the pair of the first fasteners, the pair of first washers, and the first bushing; and, the pair of first fasteners being threadedly engaged to the fixed end of the cantilever arm.

13. The tennis-stroke trainer device as claimed in claim 1 comprises:

a second fastening assembly;

the second fastening assembly comprises a pair of second fasteners, a pair of second washers, and a second bushing;

the U-shaped bracket further comprises a second hole;

the second hole laterally traversing through the lower leg;

the pair of second washers being positioned in between the pair of second fasteners;

the second bushing being positioned in between the pair of second washers;

the second bushing being mounted through the second hole;

the fixed end of the counterfort arm traversing through the pair of the second fasteners, the pair of second washers, and the second bushing; and, the pair of second fasteners being threadedly engaged to the fixed end of the counterfort arm.

14. The tennis-stroke trainer device as claimed in claim 1 comprises:

a first rotation axis being rotatably mounted between the fixed end of the cantilever arm and the upper leg;

a second rotation axis being rotatably mounted between the fixed end of the counterfort arm and the lower leg;

a third rotation axis being rotatably mounted between the training ball and the free end of the cantilever arm;

the first rotation axis and the second rotation axis being positioned colinear with each other; and, the first rotation axis and the second rotation axis being positioned perpendicular with the third rotation axis.

* * * * *